US010466735B2

(12) United States Patent
Tsai et al.

(10) Patent No.: US 10,466,735 B2
(45) Date of Patent: Nov. 5, 2019

(54) KNOB STRUCTURE

(71) Applicants: Sintai Optical (Shenzhen) Co., Ltd., ShenZhen, Guandong Province (CN); Asia Optical International Ltd., Taichung (TW)

(72) Inventors: Tsung-Mou Tsai, Taichung (TW); Chia-Kan Chang, Taichung (TW)

(73) Assignees: SINTAI OPTICAL (SHENZHEN) CO., LTD., Shenzhen, Guangdong Province (CN); ASIA OPTICAL INTERNATIONAL LTD., Taichung (TW)

( * ) Notice: Subject to any disclaimer, the term of this patent is extended or adjusted under 35 U.S.C. 154(b) by 0 days.

(21) Appl. No.: 16/210,064

(22) Filed: Dec. 5, 2018

(65) Prior Publication Data

US 2019/0107860 A1 Apr. 11, 2019

Related U.S. Application Data

(63) Continuation of application No. 14/999,787, filed on Jun. 28, 2016, now Pat. No. 10,180,698.

(51) Int. Cl.

| | |
|---|---|
| ***G05G 5/03*** | (2008.04) |
| ***G05G 5/06*** | (2006.01) |
| ***G05G 1/08*** | (2006.01) |
| ***G05G 1/10*** | (2006.01) |

(52) U.S. Cl.

CPC ..... *G05G 5/06* (2013.01); *G05G 1/08* (2013.01); *G05G 1/10* (2013.01); *G05G 5/03* (2013.01)

(58) Field of Classification Search

CPC .. G05G 5/06; G05G 1/08; G05G 5/03; G05G 1/10

See application file for complete search history.

(56) References Cited

U.S. PATENT DOCUMENTS 3,986,410 A * 10/1976 Robinson ..... G05G 5/06 74/527
7,368,673 B2 5/2008 Sato
7,404,344 B2 7/2008 Erdloff
8,294,049 B2 10/2012 Tsuduki
(Continued)

FOREIGN PATENT DOCUMENTS

CN 101211706 A 7/2008
CN 203588886 U 5/2014
(Continued)

*Primary Examiner* — Vicky A Johnson
(74) *Attorney, Agent, or Firm* — McClure, Qualey & Rodack, LLP

(57) ABSTRACT

A knob structure includes a base, a rotational element, a clicking plate and a clicking sheet. The rotational element is rotatably disposed on the base and includes inner peripheral surfaces. The clicking plate is joined to the inner peripheral surfaces of the rotational element and includes a plurality of first engaging members. The clicking sheet is joined to the base and includes at least one second engaging member. The clicking plate is held between the base and the clicking sheet to force the clicking sheet against the clicking plate. The rotational element is configured to rotate the clicking plate with respect to the clicking sheet so that the second engaging member continuously engages with the first engaging members.

20 Claims, 9 Drawing Sheets

(56) References Cited

U.S. PATENT DOCUMENTS

| | | | | |
|---|---|---|---|---|
| 10,180,698 | B2 * | 1/2019 | Tsai | G05G 1/10 |
| 2006/0278011 | A1 | 12/2006 | Miyasaka et al. | |

FOREIGN PATENT DOCUMENTS

| | | | |
|---|---|---|---|
| CN | 103971972 | A | 8/2014 |
| CN | 203950720 | U | 11/2014 |
| CN | 201782942 | U | 4/2016 |
| EP | 2594423 | A1 | 5/2013 |

* cited by examiner

KNOB STRUCTURE

CROSS REFERENCE TO RELATED APPLICATIONS

This application is a continuation application of U.S. patent application Ser. No. 14/999,787, "Knob Structure", filed on Jun. 28, 2016, now U.S. Pat. No. 10,180,698.

BACKGROUND OF THE INVENTION

Field of the Invention

The invention relates to a knob structure, and more particularly to a knob structure in which bulge portions continuously engage with and disengage from depressed portions in a relative rotation so that the user can feel clicks.

Description of the Related Art

Referring to FIG. 1, a known knob 10 for adjusting the brightness of a sight includes a base 2, a rotational element 4 and a clicking sheet 6. The base 2 is fixed to a sight (not shown). The rotational element 4 is rotatably mounted on the base 2. The clicking sheet 6 is disposed in the rotational element 4. A circuit board 3 is disposed over the clicking sheet 6. The circuit board 3 and the clicking sheet 6 are fixed to the base 2 via a bolt 5. A plurality of contact pins 1 are mounted on the circuit board 3. Tips of the contact pins 1 contact pads of another circuit board 7. The circuit board 7 is disposed in the rotational element 4. A battery 8 is disposed on and electrically connected to the circuit board 7. A cap assembly 9 covers the rotational element 4 to position the battery 8 on the circuit board 7. When the rotational element 4 is rotated by an external force, the cap assembly 9, the battery 8 and the circuit board 7 follow the rotational element 4 to rotate with respect to the base 2 and the circuit board 7 is rotated with respect to the tips of the contact pins 1, thereby regulating the magnitude of the electric current and the brightness of the sight.

FIGS. 2A and 2B depict the rotational element 4, wherein the rotational element 4 has a plurality of inner protrusions 42 and openings 44 formed between the inner protrusions 42. FIGS. 3A and 3B depict the clicking sheet 6, wherein the clicking sheet 6 has two triangular bulge portions 62 on opposite sides. Referring to FIG. 1, the inner protrusions 42 of the rotational element 4 are disposed between the clicking sheet 6 and the base 2. The clicking sheet 6 is fixed to the base 2 through the bolt 5 so that the clicking sheet 6 is forced against the inner protrusions 42 of the rotational element 4, with the bulge portions 62 engaging with the openings 44. When the rotational element 4 is rotated, the inner protrusions 42 are rotated with respect to the clicking sheet 6 and the bulge portions 62 continuously engage with and disengage from the openings 44 so that the user can feel clicks.

Generally, the rotational element 4 is made of aluminum to meet the lightweight and anti-corrosion requirements. If the rotational element 4 is made of steel, then the manufacturing cost will be significantly increased. However, the clicking sheet 6 is made of steel which is harder than aluminum. Therefore, the openings 44 of the aluminum rotational element 4 are susceptible to wear caused by the triangular bulge portions 62 after a certain number of operations, the openings 44 become wider due to the wear, and the bulge portions 62 engaging with the openings 44 are loosened. As a result, the user fails to clearly feel the clicks and the accuracy of positioning of the knob is reduced.

Further, the bulge portions 62 are triangular and the openings 44 are substantially rectangular. It is difficult to determine the interference between the bulge portions 62 and the openings 44 according to the theory of mechanics. Therefore, it is necessary to compensate and regulate the interference between the bulge portions 62 and the openings 44 according to the actual situation, which also increases the manufacturing cost.

BRIEF SUMMARY OF THE INVENTION

The invention provides a knob structure in which a clicking plate is provided between the rotational element and the clicking sheet. The bulge portions of the clicking sheet continuously engage with and disengage from the depressed portions of the clicking plate so that the user can feel clicks. The clicking plate is made of the material as hard as the clicking sheet, to improve the anti-friction ability of the clicking sheet and extend the lifespan. Further, the clicking plate instead of the rotational element is made of steel. By this arrangement, the manufacturing cost can be reduced.

The invention also provides a knob structure in which a plurality of curved bulge portions are formed on the periphery of the clicking sheet. When the curved bulge portions continuously engage with and disengage from the depressed portions, the user can feel the clicks.

In the known knob described above, the triangular bulge portion has a base length of about 5 mm and the number A of the bulge portions can be determined by dividing the circumferential length of the clicking sheet by 5 mm. In the invention, the curved portion has a diameter of about 2 mm and the number B of the bulge portions can be determined by dividing the circumferential length of the clicking sheet by 2 mm. B is greater than A. Therefore, the invention is able to provide more bulge portions on the periphery of the clicking sheet than the known knob to enhance user's feel on clicks.

The knob structure in accordance with an exemplary embodiment of the invention includes a base, a rotational element, a clicking plate and a clicking sheet. The rotational element is rotatably disposed on the base and includes inner peripheral surfaces. The clicking plate is joined to the inner peripheral surfaces of the rotational element and includes a plurality of first engaging members. The clicking sheet is joined to the base and includes at least one second engaging member. The clicking plate is held between the base and the clicking sheet to force the clicking sheet against the clicking plate. The rotational element is configured to rotate the clicking plate with respect to the clicking sheet so that the second engaging member continuously engages with the first engaging members.

In another exemplary embodiment, the first engaging members are depressed portions and the second engaging member is a bulge portion.

In yet another exemplary embodiment, the rotational element further includes a flange extending from the inner peripheral surfaces, and the clicking plate is joined to the flange.

In another exemplary embodiment, the rotational element further includes a plurality of cavities corresponding to the depressed portions, and the cavities are formed on the flange and curved.

In yet another exemplary embodiment, the rotational element further includes a plurality of recesses corresponding to the cavities, and the recesses are formed on the inner peripheral surfaces of the rotational element and oriented vertically with respect to the cavities.

In another exemplary embodiment, the clicking plate further includes a plurality of protrusions corresponding to the recesses, and clicking plate is joined to the flange by the protrusions engaging with the recesses.

In yet another exemplary embodiment, the clicking sheet includes a plurality of second engaging members which are bulge portions. The bulge portions are curved. The clicking plate is substantially ring-shaped.

In another exemplary embodiment, the first engaging members are bulge portions and the second engaging member is a depressed portion.

In yet another exemplary embodiment, the bulge portion is harder than the depressed portions.

In another exemplary embodiment, the rotational element and the clicking plate are integrally formed as a continuous unitary piece.

In yet another exemplary embodiment, the first engaging members define a plurality of through holes, the second engaging member is a bulge portion, the rotational element further comprises a plurality of cavities corresponding to the through holes, and the bulge portion extends through one of the through holes to engage with one of the cavities.

In another exemplary embodiment, the first engaging members are depressed portions, the second engaging member is a bulge portion, the rotational element define a plurality of through holes correspondingly to the depressed portions, the depressed portions extend through the through holes, and the bulge portion engages with one of the depressed portions In yet another exemplary embodiment, the first engaging members define a plurality of first through holes, the second engaging member is a bulge portion, the rotational element define a plurality of second through holes correspondingly to the first through holes, and the bulge portion extends through one of the first through holes and one of the second through holes.

In yet another exemplary embodiment, the knob structure includes a base, a rotational element and a clicking sheet. The rotational element is rotatably disposed on the base and includes inner peripheral surfaces, a flange extending from the inner peripheral surfaces, and a plurality of depressed portions formed on the flange. The clicking sheet is joined to the base and includes a periphery and at least one bulge portion disposed on the periphery. The rotational element is configured to rotate with respect to the clicking sheet so that the bulge portion continuously engages with the depressed portions. The bulge portion is curved.

In another exemplary embodiment, the bulge portion is harder than the depressed portions.

In yet another exemplary embodiment, the knob structure includes a base, a rotational element and a clicking sheet. The rotational element is rotatably disposed on the base and includes inner peripheral surfaces, a flange extending from the inner peripheral surfaces, and at least one bulge portion formed on the flange. The clicking sheet is joined to the base and includes a periphery and a plurality of depressed portions disposed on the periphery. The rotational element is configured to rotate with respect to the clicking sheet so that the bulge portion continuously engages with the depressed portions. The bulge portion is curved.

In another exemplary embodiment, the depressed portions are harder than the bulge portion A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
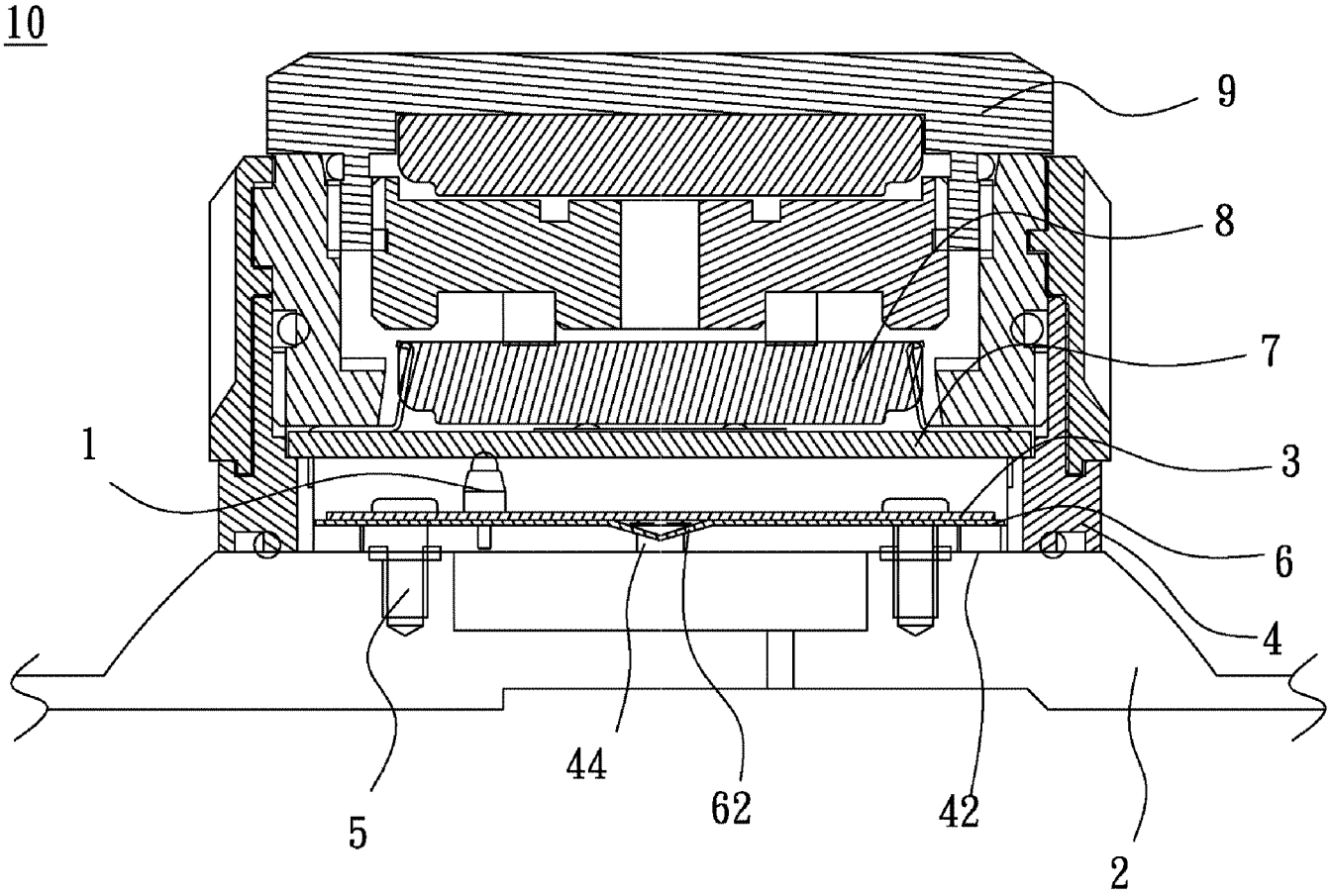
Fig. 1 (PRIOR ART)
FIG. 1 is a sectional view of a know knob.
Figure 2A:
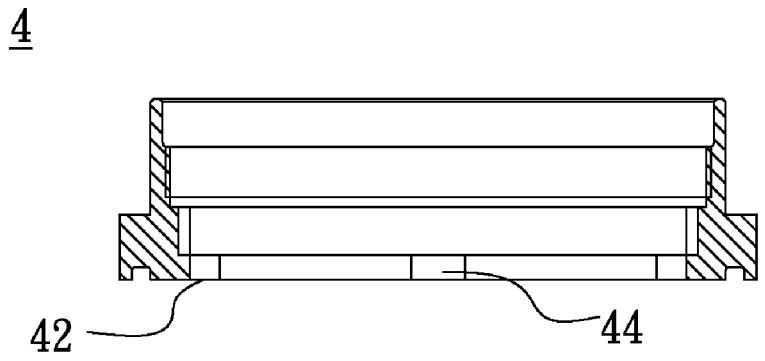
Fig. 2A (PRIOR ART)
FIG. 2A is a sectional view of a rotational element of a known knob.
Figure 2B:
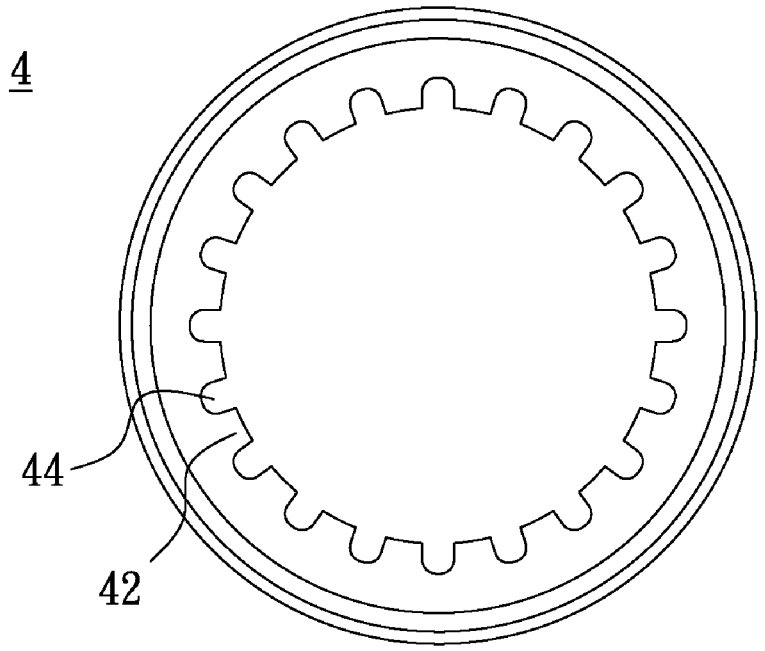
Fig. 2B (PRIOR ART)
FIG. 2B is a top view of a rotational element of a known knob.
Figure 3A:
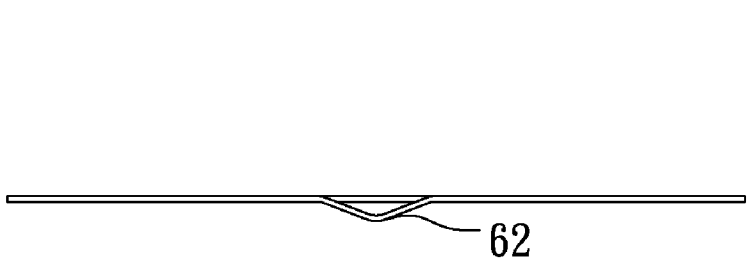
Fig. 3A (PRIOR ART)
FIG. 3A is a sectional view of a clicking sheet of a known knob.
Figure 3B:
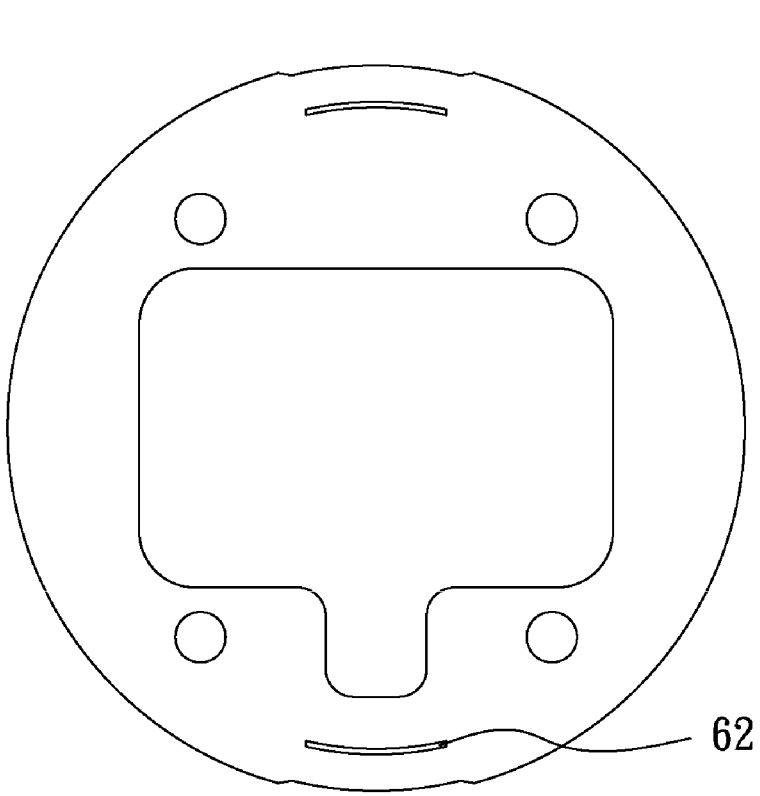
Fig. 3B (PRIOR ART)
FIG. 3B is a top view of a clicking sheet of a known knob.
Figure 4:
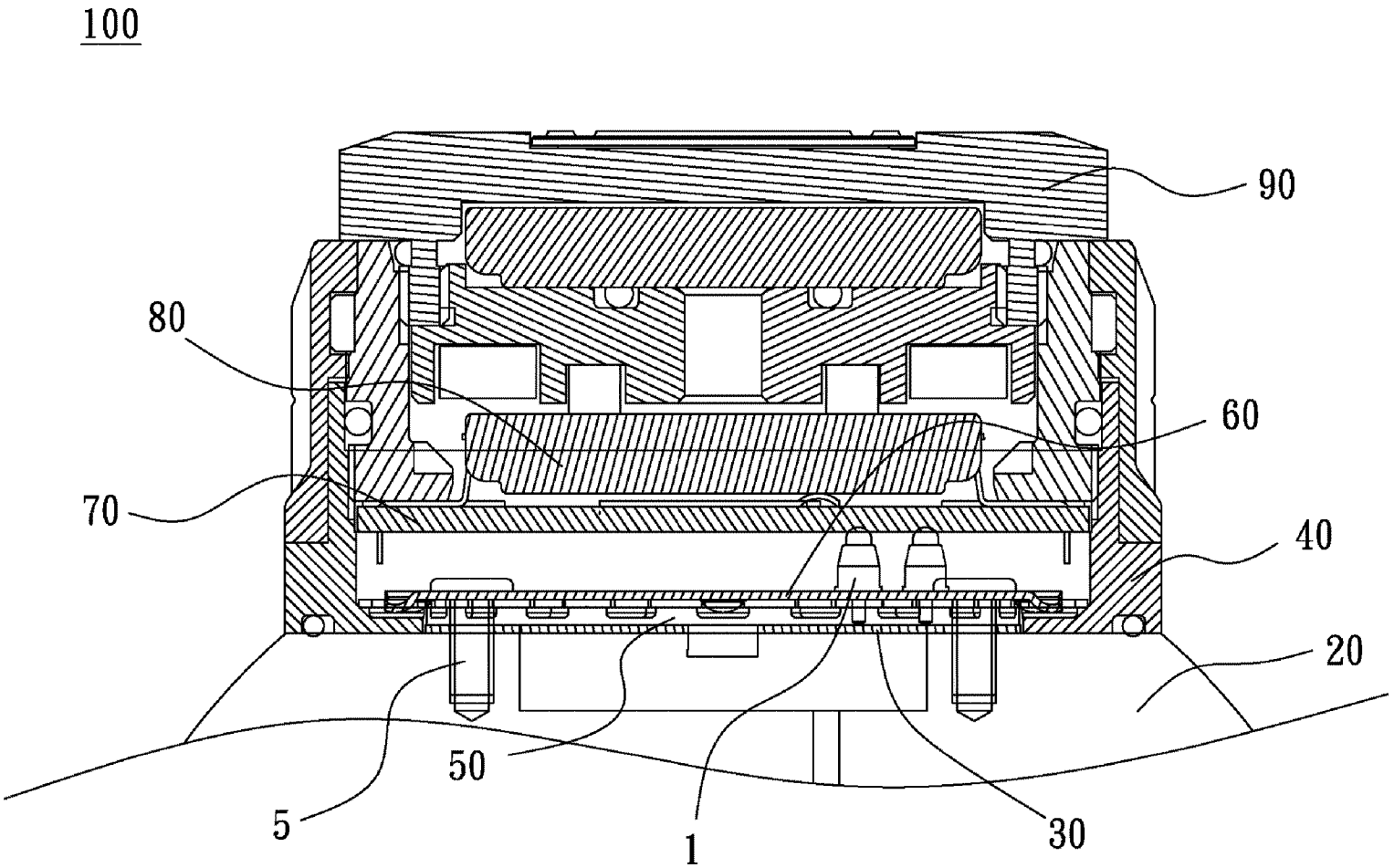
FIG. 4 is a sectional view of a knob structure in accordance with an embodiment of the invention.

Referring to FIG. 4, a knob structure 100 of the invention includes a base 20, a circuit board 30, a rotational element 40, a clicking plate 50, a clicking sheet 60, a circuit board 70, a battery 80 and a cap assembly 90.

The base 20 is fixed to a sight (not shown). The rotational element 40 is rotatably mounted on the base 20. The clicking plate 50 is joined to the rotational element 40. The clicking sheet 60 is disposed in the rotational element 40. A circuit board 30 is disposed under the clicking sheet 60. The circuit board 30 and the clicking sheet 60 are fixed to the base 20 via a bolt 5. A plurality of contact pins 1 are mounted on the circuit board 30. Tips of the contact pins 1 contact pads of the circuit board 70. The circuit board 70 is disposed in the rotational element 40. The battery 80 is disposed on and electrically connected to the circuit board 70. The cap assembly 90 covers the rotational element 40 to position the battery 80 on the circuit board 70. When the rotational element 40 is rotated by an external force, the cap assembly 90, the battery 80, the circuit board 70 and the clicking plate 50 follow the rotational element 40 to rotate with respect to the base 20 and the circuit board 70 is rotated with respect to the tips of the contact pins 1, thereby regulating the magnitude of the electric current and the brightness of the sight.

Figure 5:
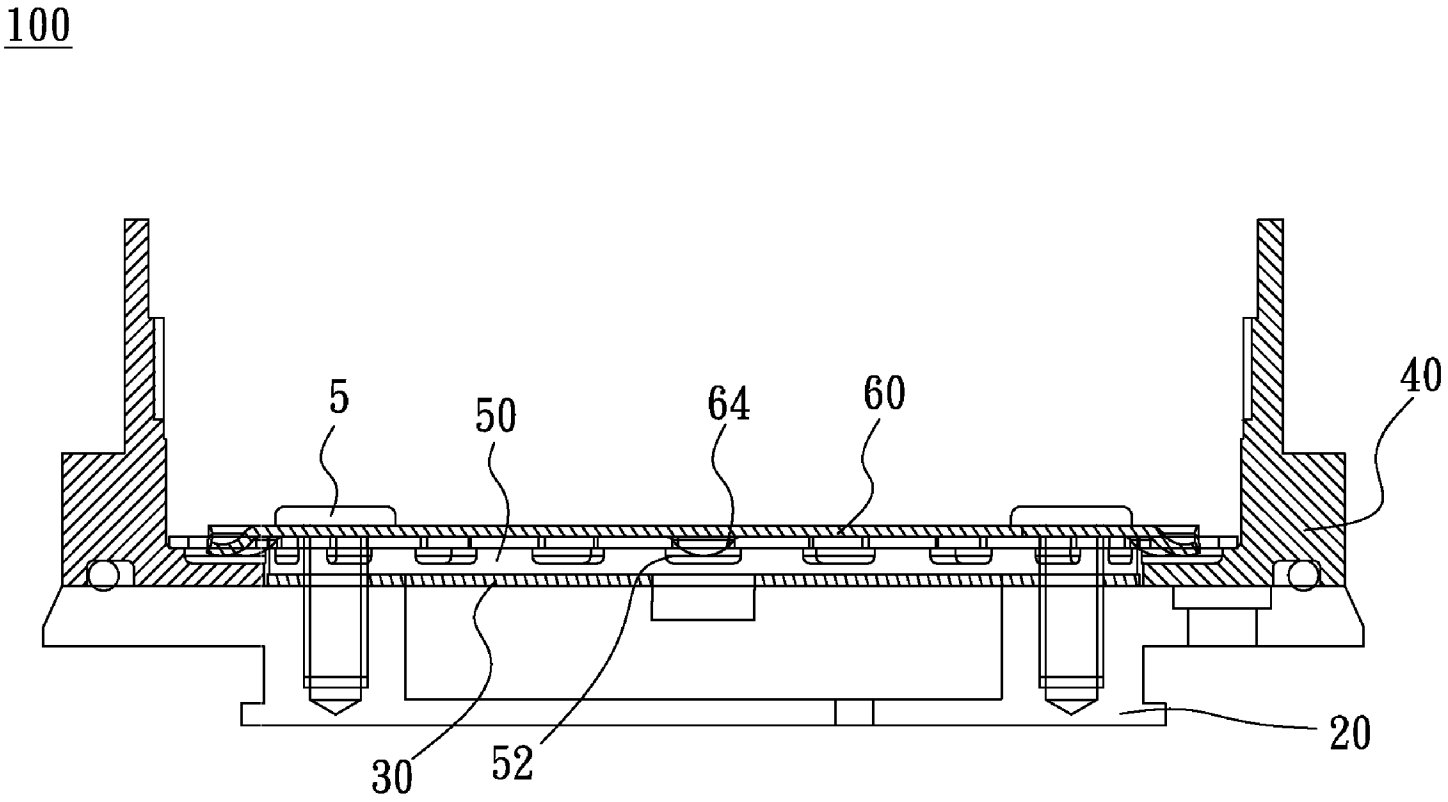
FIG. 5 is a sectional view of a knob structure of FIG. 4, with some elements removed.
Figure 6:
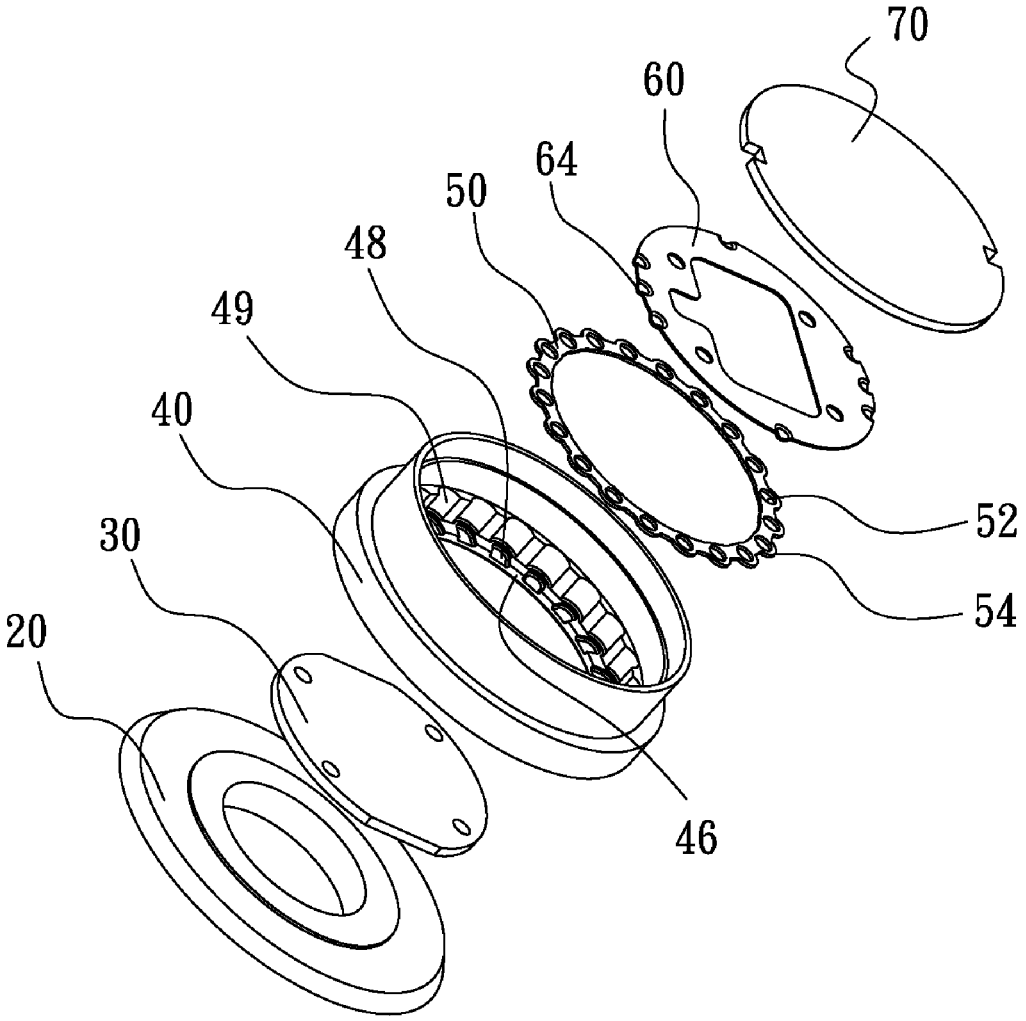
FIG. 6 is an exploded perspective view of the knob structure of FIG. 5.
Figure 7:
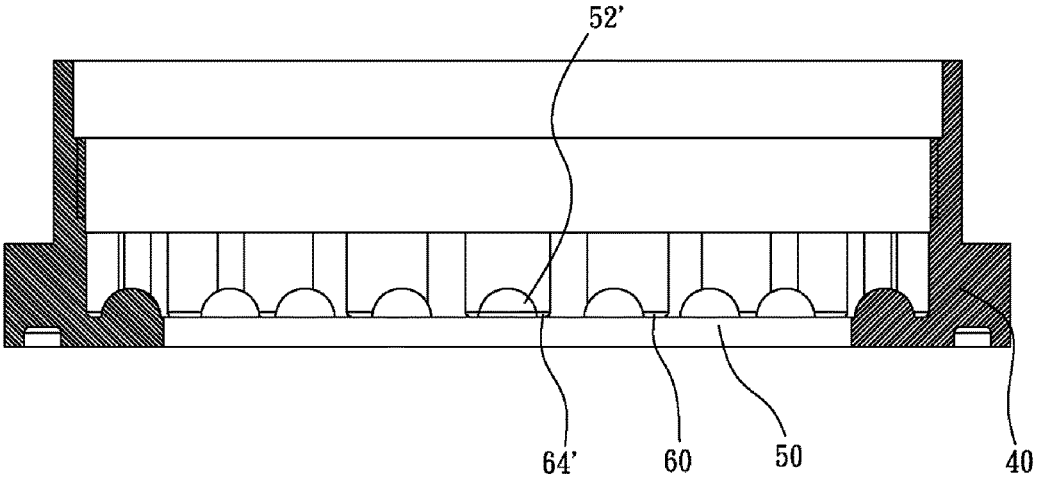
FIG. 7 is a sectional view of a knob structure in accordance with another embodiment of the invention.
Figure 8A:
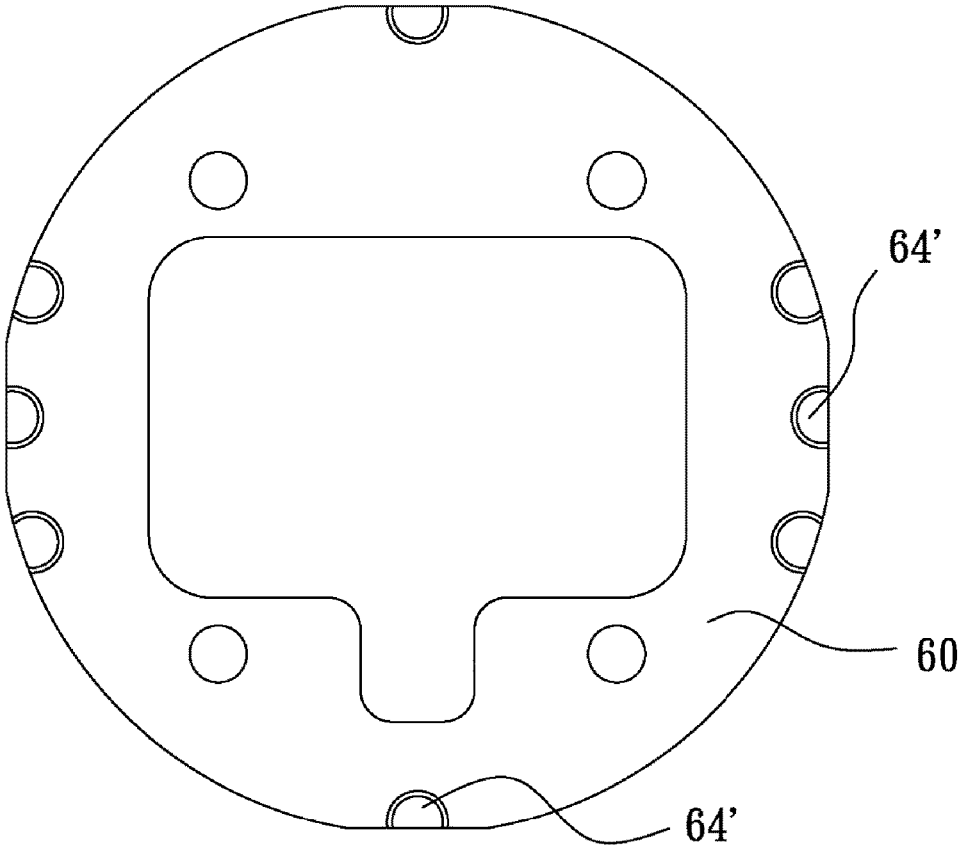
FIG. 8A is a top view of a clicking sheet of the knob structure of FIG. 7.
Figure 8B:
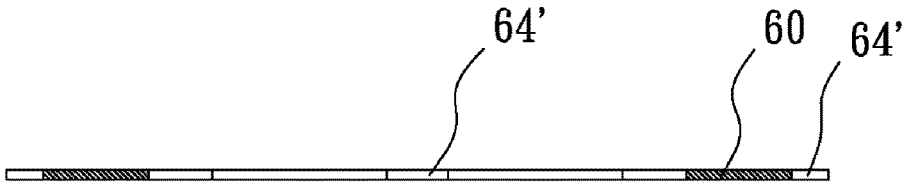
FIG. 8B is a sectional view of the clicking sheet of FIG. 8A.
Figure 9A:
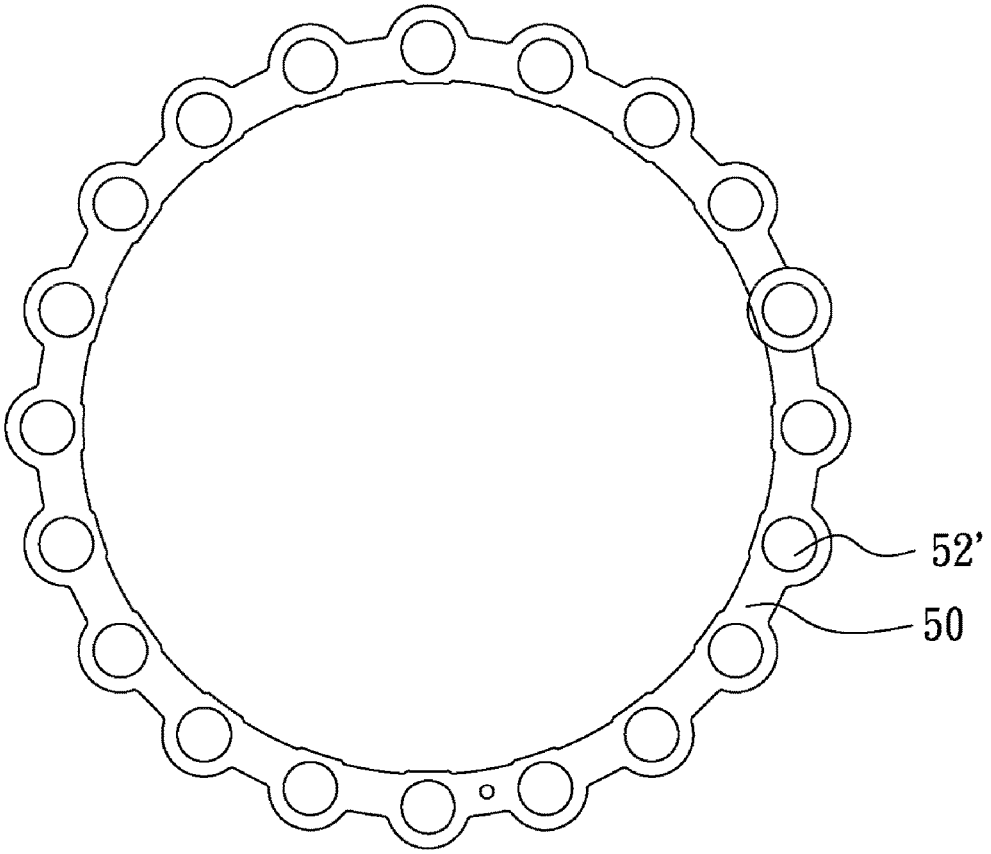
FIG. 9A is a top view of a clicking plate of the knob structure of FIG. 7.
Figure 9B:
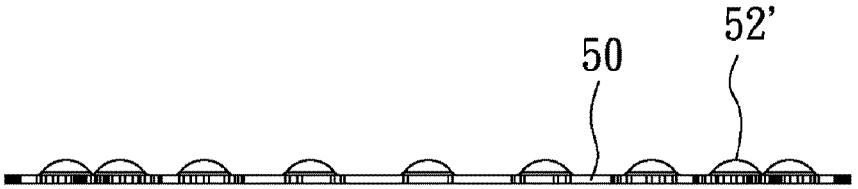
FIG. 9B is a sectional view of the clicking plate of FIG. 9A.

In FIGS. 5 and 6, the base 20, the circuit board 30, the rotational element 40, the clicking plate 50, the clicking sheet 60 and the circuit board 70 are shown and other elements are removed for easy descriptions and understanding. As shown, the rotational element 40 has a flange 46 formed on the inner peripheral surfaces thereof. A plurality of cavities 48 are formed on the flange 46. A plurality of recesses 49 corresponding to the cavities 48 are formed on the inner peripheral surfaces of the rotational element 40. The clicking plate 50 is substantially ring-shaped and has a plurality of protrusions 54 which are circumferentially provided and equally spaced. Each protrusion 54 corresponds to a first engaging member. In this embodiment, the first engaging member is a depressed portion 52. Therefore, the clicking plate 52 has a plurality of depressed portions 52 in this embodiment. The protrusions 54 engage with the cavities 48 so that the clicking plate 50 is positioned in the rotational element 40. It is understood that the clicking plate 50 and the rotational element 40 are not necessarily two pieces. Rather, the clicking plate 50 and the rotational element 40 may be integrally formed as a continuous unitary piece. As described, the clicking sheet 60 is fixed to the base 20 via the bolt 5 and pushes against the clicking plate 50 so that the clicking plate 50 and the flange 46 of the rotational element 40 are held between the base 20 and the clicking sheet 60. The clicking sheet 60 has one or more second engaging members (six bulge portions in this embodiment). When the rotational element 40 is rotated by an external force, the clicking plate 50 is rotated by the rotational element 40. The clicking plate 50 rotates with respect to the clicking sheet 60 which is fixed to the base 20. The bulge portions 64 continuously engage with and disengage from the depressed portions 52 so that the user can feel the clicks.

In this embodiment, the bulge portions 64 are curved and the depressed portions 52 are circular so that the bulge portions 64 can smoothly engage with and disengage from the depressed portions 52. Further, the clicking plate 50 and the clicking sheet 60 are made of stainless steel. Therefore, the hardness of the clicking sheet 60 is near that of the clicking plate 50. The circular depressed portions 52 of the clicking plate 50 cooperate with the curved bulge portions 64. As compared with the triangular bulge portion of the prior art, the curved bulge portions 64 of this embodiment are able to more effectively reduce the frictions between the clicking sheet 60 and the clicking plate 50, lessen the wear, and extend the life span.

The lever arm of the clicking sheet 60 is determined by the location where the clicking sheet 60 is fixed by the bolt 5. The resilient force and torque are determined by the number of the bulge portions 64. More bulge portions 64 cause a larger torque. On the other hand, fewer bulge portions 64 cause a smaller torque.

The knob structure of the invention is provided with a clicking plate between the rotational element and the clicking sheet. The bulge portions of the clicking sheet continuously engage with and disengage from the depressed portions of the clicking plate so that the user can feel the clicks. The clicking plate is made of the material as hard as the clicking sheet, to improve the anti-friction ability of the clicking sheet and extend the lifespan.

FIGS. 7, 8A, 8B, 9A and 9B show another embodiment of the invention, wherein the first engaging members of the clicking plate 50 are bulge portions 52' and the second engaging members of the clicking sheet 60 are depressed portions 64'. When the rotational element 40 is rotated by an external force, the clicking plate 50 is rotated with respect to the clicking sheet 60 by the rotational element 40. The bulge portions 52' continuously engage with and disengage from the depressed portions 64' so that the user can feel the clicks.

In yet another embodiment, the first engaging members of the clicking plate are not depressed portions. Instead, the first engaging members define a plurality of through holes corresponding to the cavities of the rotational element. The second engaging member of the clicking sheet is still a bulge portion. The bulge portion extends through one of the through holes to engage with one of the cavities.

In another embodiment, the first engaging members of the clicking plate are still depressed portions. The second engaging member of the clicking sheet is still a bulge portion. However, the cavities of the rotational element are changed to through holes. The depressed portions extend through the through holes, and the bulge portion engages with one of the depressed portions.

In yet another embodiment, the first engaging members of the clicking plate are not depressed portions. Instead, the first engaging members define a plurality of first through holes. The second engaging member of the clicking sheet is still a bulge portion. The cavities of the rotational element are changed to a plurality of second through holes correspondingly to the first through holes. The bulge portion extends through one of the first through holes and one of the second through holes.

In another embodiment, the knob structure does not include any clicking plate. A plurality of depressed portions are formed on the flange of the rotational element and a plurality of curved bulge portions are formed on the clicking sheet. When the rotational element is rotated, the curved bulge portions continuously engage with and disengage from the depressed portions so that the user can feel the clicks.

In yet another embodiment, the knob structure does not include any clicking plate. A plurality of bulge portions are formed on the flange of the rotational element and a plurality of curved depressed portions are formed the clicking sheet. When the rotational element is rotated, the bulge portions continuously engage with and disengage from the depressed portions so that the user can feel the clicks.

What is claimed is:

1. A knob structure comprising:

a base;

a rotational element rotatably disposed on the base and comprising inner peripheral surfaces;

a clicking plate joined to the inner peripheral surfaces of the rotational element and comprising a plurality of first engaging members; and a clicking sheet joined to the base and comprising at least one second engaging member;

wherein the clicking plate is held between the base and the clicking sheet to force the clicking sheet against the clicking plate, and the rotational element is configured to rotate the clicking plate with respect to the clicking sheet so that the second engaging member continuously engages with the first engaging members;

wherein the first engaging members are bulge portions, and the second engaging member is a depressed portion;

wherein the rotational element further comprises a flange extending from the inner peripheral surfaces, and the clicking plate is joined to the flange;

wherein the rotational element further comprises a plurality of cavities corresponding to the bulge portions, and the cavities are formed on the flange and curved.

2. The knob structure as claimed in claim 1, wherein the rotational element further comprises a plurality of recesses corresponding to the cavities, and the recesses are formed on the inner peripheral surfaces of the rotational element and oriented vertically with respect to the cavities.

3. The knob structure as claimed in claim 2, wherein the clicking plate further comprises a plurality of protrusions corresponding to the recesses, and the clicking plate is joined to the flange by the protrusions engaging with the recesses.

4. The knob structure as claimed in claim 1, wherein the bulge portions are harder than the depressed portion.

5. The knob structure as claimed in claim 1, wherein the rotational element and the clicking plate are integrally formed as a continuous unitary piece.

6. A knob structure comprising:

a base;

a rotational element rotatably disposed on the base and comprising inner peripheral surfaces;

a clicking plate joined to the inner peripheral surfaces of the rotational element and comprising a plurality of first engaging members; and a clicking sheet joined to the base and comprising at least one second engaging member which is a bulge portion;

wherein the clicking plate is held between the base and the clicking sheet to force the clicking sheet against the clicking plate, and the rotational element is configured to rotate the clicking plate with respect to the clicking sheet so that the second engaging member continuously engages with the first engaging members;

wherein the rotational element further comprises a plurality of third engaging members corresponding to the first engaging members and a plurality of recesses corresponding to the third engaging members, and the clicking plate further comprises a plurality of protrusions corresponding to the recesses.

7. The knob structure as claimed in claim 6, wherein the rotational element further comprises a flange extending from the inner peripheral surfaces, and the clicking plate is joined to the flange.

8. The knob structure as claimed in claim 7, wherein the third engaging members are formed on the flange.

9. The knob structure as claimed in claim 8, wherein the recesses are formed on the inner peripheral surfaces of the rotational element and oriented vertically with respect to the third engaging members.

10. The knob structure as claimed in claim 9, wherein the clicking plate is joined to the flange by the protrusions engaging with the recesses.

11. The knob structure as claimed in claim 6, wherein the first engaging members define a plurality of through holes, the third engaging members are cavities, and the bulge portion extends through one of the through holes to engage with one of the cavities.

12. The knob structure as claimed in claim 6, wherein the first engaging members are depressed portions, the third engaging members define a plurality of through holes, the depressed portions extend through the through holes, and the bulge portion engages with one of the depressed portions.

13. The knob structure as claimed in claim 12, wherein the bulge portion is harder than the depressed portions.

14. The knob structure as claimed in claim 6, wherein the first engaging members define a plurality of first through holes, the third engaging members define a plurality of second through holes, and the bulge portion extends through one of the first through holes and one of the second through holes.

15. The knob structure as claimed in claim 6, wherein the rotational element and the clicking plate are integrally formed as a continuous unitary piece.

16. A knob structure comprising:

a base;

a rotational element rotatably disposed on the base and comprising inner peripheral surfaces, a flange extending from the inner peripheral surfaces, and a plurality of first engaging members formed on the flange; and a clicking sheet joined to the base and comprising a periphery and at least one second engaging member disposed on the periphery;

wherein the rotational element is configured to rotate with respect to the clicking sheet so that the second engaging member continuously engages with the first engaging members, and the second engaging member is curved.

17. The knob structure as claimed in claim 16, wherein the first engaging members are depressed portions, and the second engaging member is a bulge portion.

18. The knob structure as claimed in claim 17, wherein the bulge portion is harder than the depressed portions.

19. The knob structure as claimed in claim 16, wherein the first engaging members are bulge portions, and the second engaging member is a depressed portion.

20. The knob structure as claimed in claim 19, wherein the bulge portions are harder than the depressed portion.

* * * * *